US005473858A

United States Patent [19]

Hayes

[11] Patent Number: 5,473,858

[45] Date of Patent: Dec. 12, 1995

[54] APPARATUS AND METHOD FOR ENCLOSING BULK PRODUCT WITHIN A FLEXIBLE SHEET

[76] Inventor: Rosemary C. Hayes, 5816 Oakmont La., Fort Worth, Tex. 76112

[21] Appl. No.: 276,210

[22] Filed: Jul. 18, 1994

[51] Int. Cl.[6] ..... B65B 51/08

[52] U.S. Cl. ..... 53/414; 53/456; 53/390; 53/138.7; 53/575

[58] Field of Search ..... 53/414, 464, 219, 53/221, 390, 138.6, 138.7, 138.8, 575, 577, 456, 255

[56] References Cited

U.S. PATENT DOCUMENTS

| | | | |
|---|---|---|---|
| 2,118,551 | 5/1938 | Doble | 53/464 |
| 2,148,587 | 2/1939 | Slocum | 53/225 |
| 2,165,840 | 7/1939 | Doble | 53/221 |
| 2,265,636 | 11/1939 | Eaton | 53/138.7 |
| 3,321,103 | 4/1965 | Phillips | 53/390 |
| 4,555,893 | 12/1985 | Nakata et al. | 53/464 |
| 5,001,885 | 3/1991 | Borella | 53/221 |

*Primary Examiner*—John Sipos
*Assistant Examiner*—Ed Tolan
*Attorney, Agent, or Firm*—James E. Bradley; Max Ciccarelli

[57] ABSTRACT

The apparatus has a frame having a top portion with an opening. The frame frictionally supports the middle portion of the string in an initial position behind the opening. A movable funnel is adapted to force a sheet from an initial position above the opening to an intermediate position in which the sheet is located partially through the opening, around the funnel, and in front of the middle portion of the string. A selected quantity of bulk product is poured into the funnel and a knot is tied in the string in front of the sheet. As the knot is tightened, the string forces the funnel upward and the string tightens around the sheet thus forming an enclosed volume with the sheet in a final position around the product.

17 Claims, 2 Drawing Sheets

APPARATUS AND METHOD FOR ENCLOSING BULK PRODUCT WITHIN A FLEXIBLE SHEET

BACKGROUND OF THE INVENTION

1. Field of the Invention

This invention relates in general to an apparatus and method for enclosing a bulk product within a flexible sheet, and in particular to an apparatus and method for manually enclosing and tying a small portion of rice, bird seed, or the like within a fabric.

2. Description of the Prior Art

Enclosing selected quantities of bulk product within a flexible sheet has been done for many years. Usually, the flexible sheet is a piece of fabric, and the fabric is wrapped around the selected quantity of bulk product and a string or ribbon tied around the fabric, immediately above the product, so as to form a bag or pouch within which the product is contained.

At weddings, for example, such bags or pouches are filled with rice or bird-seed and given to the guests to throw the rice or bird-seed at the newlywed couple. Such bags are also used to package treats for party favors, or confetti for a celebration. When such bags are filled with herbs and spices they make seasoning bags for cooking, and when the bags are filled with potpourri they make convenient air-fresheners.

Traditionally, these bags are made by hand. The bulk product is placed on a circular piece of fabric, and the fabric is then painstakingly wrapped around the product and held in place while the string or ribbon is tied around the fabric. This procedure is a tricky one to perform, especially if it is performed by only one person. Wrapping the fabric around the product and holding it in position while tying the string is a painstaking and time consuming procedure. Also, bags tied by the above method are often irregular in appearance.

The need exists for an apparatus and method for manually enclosing a selected quantity of bulk product within a flexible sheet. The apparatus and method should form bags of uniform appearance quickly, cheaply, and conveniently. Also the apparatus should be compact in size to provide for ease of storage and transportation.

SUMMARY OF THE INVENTION

It is the general object of the invention to provide an apparatus and method for manually enclosing a selected quantity of bulk product within a flexible sheet.

The apparatus of this invention has a frame having a base portion and a top portion supported above the base portion. An opening extends through the top portion. The frame is adapted to support the middle portion of a string in an initial position behind the opening. The top portion is adapted to support a sheet in an initial position over the opening. A movable funnel is adapted to fit within the opening and force the sheet from the initial position to an intermediate position. In the intermediate position, the sheet is located partially through the opening, around the funnel, and in front of the middle portion of the string. The apparatus is designed so that the selected quantity of bulk product can be poured through the funnel and into the sheet. A knot is tied in the string in front of the sheet. As the knot is tightened the string pushes the funnel upward and the string is tied around the sheet so as to form an enclosed volume with the sheet in a final position around the product.

The above as well as additional objects, features, and advantages will become apparent in the following description.

DETAILED DESCRIPTION OF THE INVENTION

Figure 1:
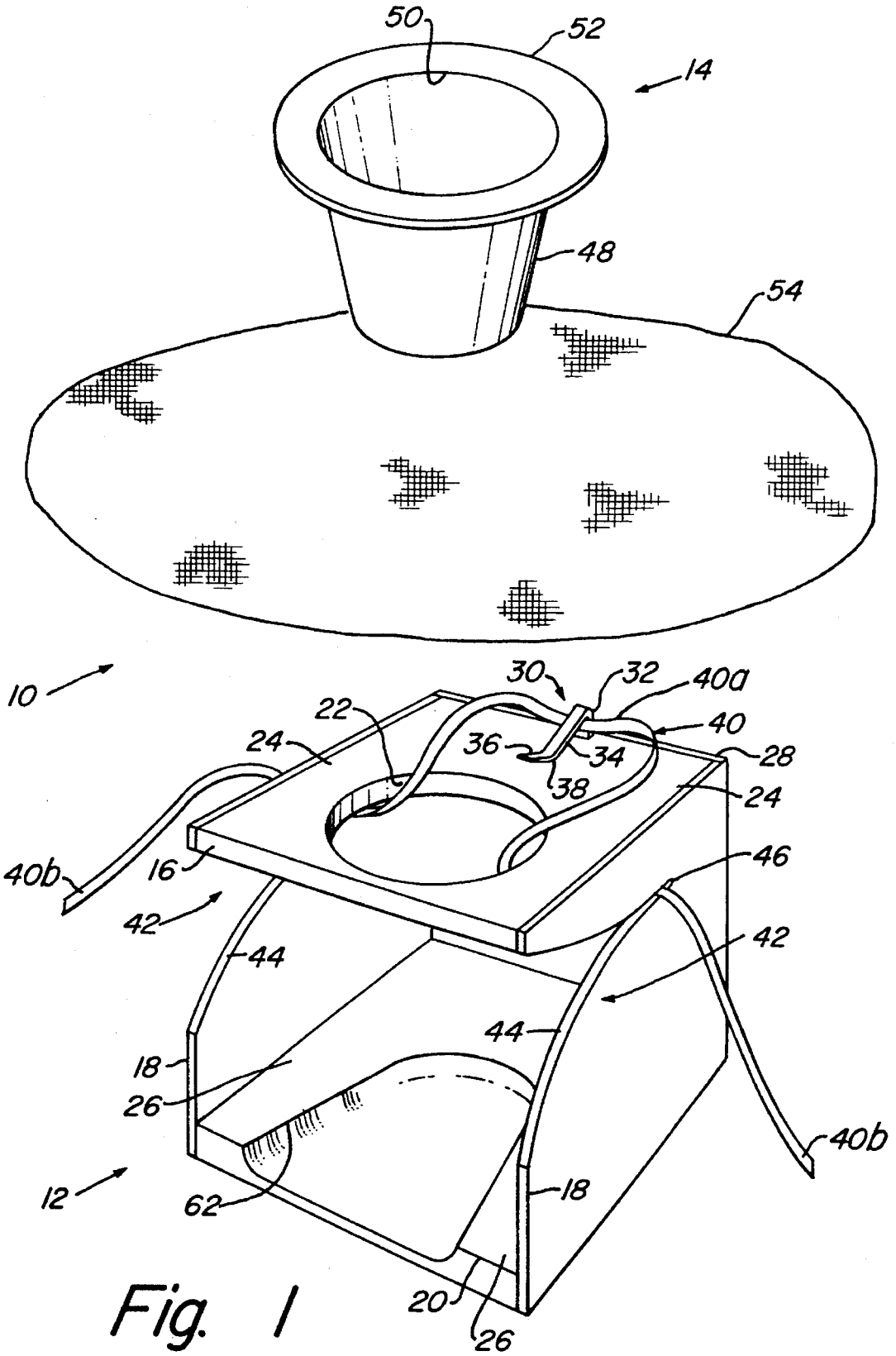
FIG. 1 is an exploded perspective view of the apparatus of the present invention with the components shown in the initial position.

FIG. 1 shows the bagging apparatus 10 of the present invention for enclosing selected quantities of bulk product within a flexible sheet. Bagging apparatus 10 generally includes a frame portion 12 and a funnel 14. Frame portion 12 has a top portion 16 supported by sidewalls 18 above a base portion 20. Top portion 16 is supported in a substantially horizontal position. A circular opening 22 extends vertically through top portion 16.

Each sidewall 18 is connected to a side edge 24 of top 16. Sidewalls 18 extend vertically downward and are connected at their lower ends to the side edges 26 of base portion 20. Top portion 16, sidewalls 18 and base portion 20 form frame 12 wherein top portion 16 is supported above base portion 20. Frame 12 of the preferred embodiment also includes a back portion 28 for improved rigidity, strength, and appearance. The front of frame 12 is open.

Frame 12 also includes upper string retaining means 30 located on top portion 16. Upper string retaining means 30 has a vertical post 32 mounted towards the rear of top portion 16. Extending forward and downward from the upper portion of post 32 is a resilient spring or arm 34. The distal end of flexible arm 34 is turned upward to form a lip 36. Vertical post 32 and flexible arm 34 are adapted so that an apex 38 located between flexible arm 34 and lip 36 contacts the upper surface of top portion 16. Upper string retaining means 30 allows a ribbon or string 40 to be selectively retained by the resiliency of spring 34 as further described herein.

Frame 12 also has two lower string retaining means 42. One lower string retaining means 42 is located on one of the two sidewalls 18, and the other lower string retaining means 42 is located on the other sidewall 18. In the preferred embodiment, lower string retaining means 42 comprise slots 44 formed into sidewalls 18. Each slot 44 has a relatively wide opening towards the front of the sidewall. Each slot 44 tapers or converges toward apexes 46 (only one apex 46 is shown in FIG. 1) near the rear of sidewalls 18. At apexes 46, slots 44 are narrow enough to hold string 40 as further described herein. The operation of lower string retaining means 42 is also described in more detail herein.

Figure 2:
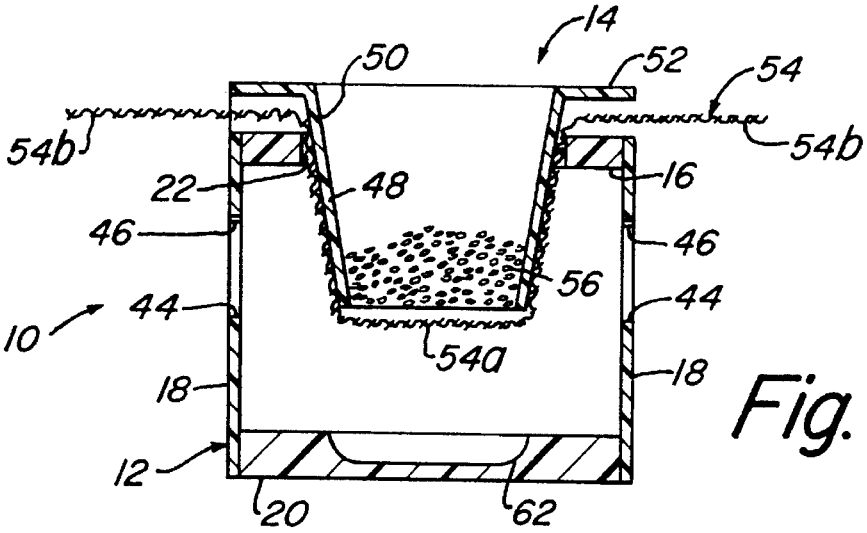
FIG. 2 is a vertical cross sectional view of the apparatus of the present invention as seen from the front, and with the components shown in the intermediate position.

Funnel 14 has annular conical sidewalls 48. Sidewalls 48 form an opening 50 through funnel 14. Funnel 14 is adapted to fit partially within opening 22 of top portion 16, as shown in FIG. 2. The lower portion of sidewall 48 has an outer diameter smaller than the diameter of opening 22, and the upper portion of sidewall 48 has an outer diameter slightly greater than the diameter of opening 22. Funnel 14 also has a flange 52 at its upper portion to facilitate grasping funnel 14, and to insure that funnel 14 does not pass through opening 22. The operation of funnel 14 is described in more detail herein.

In operation, the apparatus and method of the present invention function as follows. String 40 is first placed in its initial position. Generally speaking, the initial position for the string is any position in which the middle portion 40*a* of string 40 is located behind opening 22. In the preferred embodiment, the initial position for string 40 is one wherein string 40 extends through opening 22, and wherein the middle portion 40*a* of string 40 is being retained by upper string retaining means 30 and ends 40*b* are being retained by lower string retaining means 42. The above-described preferred initial position of string 40 is illustrated in FIG. 1. String 40 can be any type of string-like material such as ordinary string or ribbon.

The operation of upper string retaining means 30 is as follows. A middle portion 40*a* of string 40 is placed below lip 36 and is then pushed rearward. When the middle portion 40*a* of string 40 is pushed rearward, flexible arm 34 deflects upward so as to allow string 40 to pass under apex 38. Because of the thickness of string 40 and the fact that apex 38 is in contact with the upper surface of top portion 16, middle portion 40*a* of sting 40 will be retained within upper string retaining means 30 until sufficient force is applied to string 40 to cause string 40 to be pulled out of upper string retaining means 30. Thus, it can be seen that upper string retaining means 30 selectively retains middle portion 40*a* of string 40 on top portion 16 behind opening 22.

The operation of lower string retaining means 42 is as follows. Ends 40*b* of string 40 are located below opening 22. One end 40*b* of string 40 is placed into one slot 44 and moved to the rear of slot 44 so as to become engaged with apex 46. The thickness of slot 44 at apex 46 is smaller than the thickness of string 40 so that as string 40 is slid towards the rear of slot 44, string 40 becomes engaged with apex 46. End 40*b* of string 40 will be retained within slot 44 until sufficient force is applied to end 40*b* to pull it out of slot 44. The other end 40*b* of string 40 is similarly placed into, and selectively retained by, the other slot 44. As can be seen from FIG. 1, lower string retaining means 42 retain ends 40*b* of string 40 outside frame 12, thus making ends 40*b* readily accessible and easily grasped.

Once string 40 is placed in its initial position, a flexible sheet is then placed on top portion 16 in an initial position centered above opening 22. Flexible sheet 54 can be made of any thin, flexible material such as fabric, gauze, plastic, or any other thin flexible material. After flexible sheet 54 is placed in its initial position over opening 22, funnel 14 is placed above flexible sheet 54 in a position centered over opening 22. Funnel 14 is then pushed into opening 22, thus forcing flexible sheet 54 from the initial position to an intermediate position in which the sheet is located partially through the opening, around the funnel, and in front of middle portion 40*a* of string 40, as shown in FIG. 2.

FIG. 2 shows a vertical cross-section of bagging apparatus 10 in the intermediate position as seen from the front of the apparatus. String 40 is not shown in FIG. 2 for purposes of clarity. Funnel 14 has been inserted into opening 22 and has forced flexible sheet 54 into the intermediate position. In the intermediate position, flexible sheet 54 is located partially through the opening and surrounds the lower portion of sidewall 48 of funnel 14. As shown in FIG. 2, a central portion 54*a* of flexible sheet 54 is located through and below the opening, and the peripheral portion of 54*b* of flexible sheet 54 is located above opening 22. Flange 52 of funnel 14 is spaced slightly above top portion 16. Although not shown in FIG. 2, middle portion 40*a* of string 40 is located behind opening 22 and hence behind funnel 14.

A selected quantity of bulk material 56 is then inserted into opening 50 of funnel 14. Bulk material 56 comes to rest at the bottom of funnel 14 and is supported by central portion 54*a* of flexible sheet 54. Bulk material 56 can be any type of bulk material such as rice, birdseed, candy and other treats, confetti, or any other bulk product.

Figure 3:
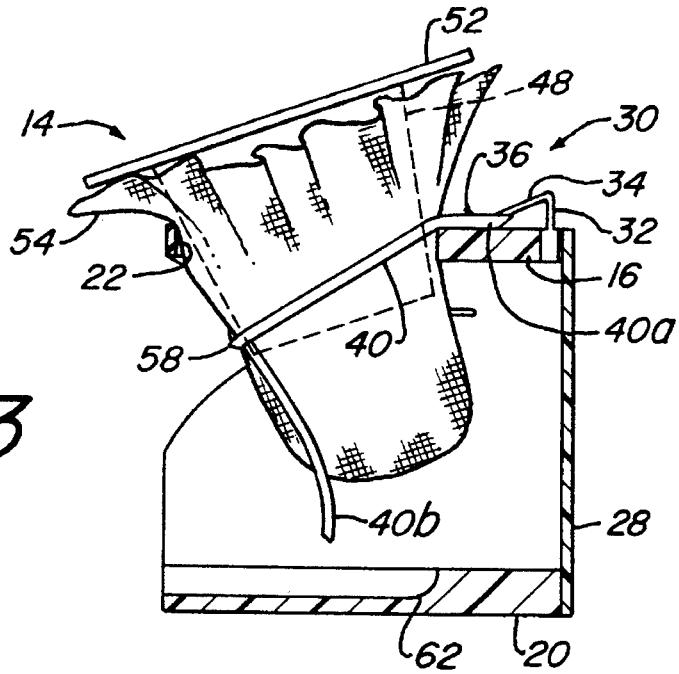
FIG. 3 is a vertical cross sectional view of the apparatus of the present invention as seen from the side, and with the components shown between the intermediate position and the final position.

FIG. 3 is a vertical cross sectional view of the apparatus of the present invention as seen from the side. Referring now to FIG. 3, ends 40*b* of string 40, which are being held by lower string retaining means 42 in a convenient position in which they are easily grasped, are grasped and pulled out of lower string retaining means 42. Ends 40*b* are pulled forward in front of funnel 14. A knot 58 is tied in string 40 in front of funnel 14. As knot 58 is tightened, string 40 forces funnel 14 upward out of opening 22. The conical shape of sidewall 48 of funnel 14 helps string 40 in forcing funnel 14 upward as string 40 is tightened.

Also shown in FIG. 3 is upper string retaining means 30. Flexible arm 34 retains string 40 in a position behind opening 22 until enough force is applied to string 40. As knot 58 is tightened, enough force will eventually be applied to string 40 to cause string 40 to deflect flexible arm 34 upward, thus allowing middle portion 40*a* of string 40 to be released from upper string retaining means 30. Thus, it is seen that upper string retaining means 30 serves as a means for selectively retaining middle portion 40*a* of string 40.

As knot 58 is further tightened, funnel 14 will be pushed completed above string 40, and string 40 will completely tighten around flexible sheet 54 thus enclosing bulk material 56 within flexible sheet 54. Once string 40 is completely tightened around flexible sheet 54, the resulting bag or pouch 60 will fall downward toward base portion 20. A slot 62 in base portion 20 facilitates the removal of bag 60.

Figure 4:
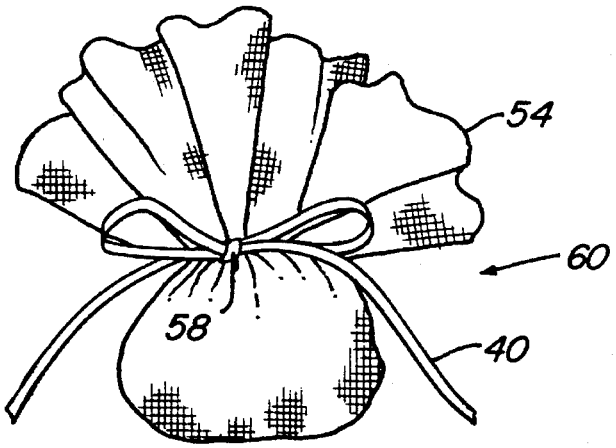
FIG. 4 is a perspective view of a selected quantity of bulk product enclosed within a thin, flexible sheet and tied by a string with the apparatus and method of the present invention.

Referring now to FIG. 4, bag or pouch 60 made with the apparatus and method of this invention is shown. Flexible sheet 54 is shown in its final position enclosing bulk material 56 (bulk material 56 is not visible) below knot 58.

The bagging apparatus and method of the present invention provides considerable advantages over the currently available methods. Using the apparatus and/or method of the present invention allows bags to be made faster, cheaper, and more conveniently than without the assistance of such apparatus or method. Also, the apparatus and/or method of the present invention forms bags of more uniform appearance. Finally, the bagging apparatus of the present invention is compact in size and can be easily stored or transported.

While the invention has been particularly shown and described with reference to a preferred embodiment, it will be understood by those skilled in the art that various changes in form and detail may be made therein without departing from the spirit and scope of the invention.

What is claimed is:

1. An apparatus for manually enclosing a selected quantity of bulk product within a thin, flexible sheet and manually tying a string having a middle portion and two ends around the sheet, the apparatus comprising:

a frame having a rear, a front, a base portion, and a top portion supported above the base portion;

an opening extending through the top portion;

the top portion being adapted to support the middle portion of the string in an initial position behind the opening;

the top portion being adapted to support the sheet in an initial position over the opening; and a movable funnel means including a conical funnel for placing within the opening for forcing the sheet from the initial position to an intermediate position in which the sheet is located partially through the opening, around the funnel means, and in front of the middle portion of the string, for allowing the product to be poured through the funnel means and into the sheet, and a knot to be tied in the string in front of the sheet, whereby as the knot is tightened the string forces the funnel means upward and the string tightens around the sheet so as to form an enclosed volume with the sheet in a final position around the product.

2. The apparatus according to claim 1 wherein the opening is a circular opening.

3. The apparatus according to claim 1 further comprising upper string retaining means located on the top portion behind the opening for selectively retaining the middle portion of the string behind the opening in the initial position.

4. The apparatus according to claim 1 further comprising lower string retaining means located on each side of the frame between the top portion and the base portion for selectively retaining the ends of the string in an easily accessible position.

5. The apparatus according to claim 1 wherein the frame has side walls connecting the base portion and the top portion wherein the apparatus further comprises lower string retaining means integrally formed into each side wall of the apparatus for selectively retaining the ends of the string in an easily accessible position.

6. An apparatus for manually enclosing a selected quantity of bulk product within a thin, flexible sheet and manually tying a string having a middle portion and two ends around the sheet, the apparatus comprising:

a frame having a rear, a front, a base portion, and a top portion supported above the base portion by side walls connecting the base portion and the top portion;

an opening extending through the top portion;

the top portion being adapted to support the middle portion of the string in an initial position behind the opening;

the top portion being adapted to support the sheet in an initial position over the opening;

a movable funnel means for placing within the opening for forcing the sheet from the initial position to an intermediate position in which the sheet is located partially through the opening, around the funnel means, and in front of the middle portion of the string, for allowing the product to be poured through the funnel means and into the sheet, and a knot to be tied in the string in front of the sheet, whereby as the knot is tightened the string forces the funnel means upward and the string tightens around the sheet so as to form an enclosed volume with the sheet in a final position around the product; and lower string retaining means comprising slots formed into the side walls between the base portion and the top portion, the slots tapering to an apex toward the rear of the apparatus for selectively retaining the ends of the string within the slots in an easily accessible position.

7. An apparatus for manually enclosing a selected quantity of bulk product within a thin, flexible sheet and manually tying a string having a middle portion and two ends around the sheet, the apparatus comprising:

a frame having a rear, a front, a base portion, and a top portion supported above the base portion;

an opening extending through the top portion;

the top portion being adapted to support the middle portion of the string in an initial position behind the opening;

the top portion being adapted to support the sheet in an initial position over the opening;

a movable funnel means for placing within the opening for forcing the sheet from the initial position to an intermediate position in which the sheet is located partially through the opening, around the funnel means, and in front of the middle portion of the string, for allowing the product to be poured through the funnel means and into the sheet, and a knot to be tied in the string in front of the sheet, whereby as the knot is tightened the string forces the funnel means upward and the string tightens around the sheet so as to form an enclosed volume with the sheet in a final position around the product; and the funnel means having annular conical sidewalls to facilitate the upward movement of the funnel means as the knot in the string is tightened.

8. The apparatus according to claim 1 wherein the funnel means has an upper portion of diameter larger than the opening to support the funnel means on the top portion of the frame.

9. An apparatus for manually enclosing a selected quantity of bulk product within a thin, flexible sheet and manually tying a string having a middle portion and two ends around the sheet, the apparatus comprising:

a frame having a rear, a front, a base portion, and a top portion supported above the base portion;

a substantially horizontal circular opening extending through the top portion;

upper string retaining means located on the top portion behind the opening for selectively retaining the middle portion of the string behind the opening;

lower string retaining means located on each side of the frame between the top portion and the base portion for selectively retaining the ends of the string in an easily accessible position;

the top portion being adapted to support the sheet in an initial position over the opening;

a movable funnel means for placing within the opening for forcing the sheet from the initial position to an intermediate position in which the sheet is located partially through the opening, around the funnel means, and in front of the middle portion of the string;

the funnel means having an opening therethrough for allowing the product to be poured through the funnel means and into the sheet; and the funnel means having annular conical sidewalls whereby as a knot is tied in front of the funnel means and then tightened, the string forces the funnel means upward and the string tightens around the sheet so as to form an enclosed volume with the sheet in a final position around the product.

10. The apparatus according to claim 9 wherein the upper string retaining means comprises a resilient spring means for selectively retaining the middle portion of the string.

11. The apparatus according to claim 9 wherein the frame has side walls connecting the base portion and the top portion wherein the lower string retaining means are integrally formed into each side wall of the apparatus.

12. The apparatus according to claim 9 wherein the frame has side walls connecting the base portion and the top portion wherein the lower string retaining means comprises slots formed into the side walls between the base portion and the top portion, the slots tapering to an apex toward the rear of the apparatus for selectively retaining the ends of the string within the slots in an easily accessible position.

13. The apparatus according to claim 9 wherein the funnel means has an upper portion of diameter larger than the opening to support the funnel means on the top portion of the frame.

14. A method for manually enclosing a selected quantity of bulk product within a thin, flexible sheet and manually tying a string having a middle portion and two ends around the sheet, the method comprising the steps of:

providing a frame having rear, a front, a base portion, and a top portion supported above the frame portion, the top portion having an opening therethrough;

placing the string in an initial position in which the middle portion of the string is located behind the opening;

placing the sheet in an initial position over the opening;

forcing the sheet with a conical funnel from the initial position to an intermediate position in which the sheet is located partially through the opening, around the funnel, and in front of the middle portion of the string;

pouring the product through an opening in the funnel and into the sheet while the sheet is in the intermediate position;

tying a knot in the string in front of the funnel; then tightening the knot, wherein the string forces the funnel upward and wherein the string tightens around the sheet so as to form an enclosed volume with the sheet in a final position around the product.

15. The method according to claim 14 wherein the step of placing the string comprises frictionally retaining the middle portion of the string at a selected point on the frame.

16. The method according to claim 14 wherein the step of placing the string comprises:

placing the string through the opening; and frictionally retaining the middle portion of the string behind the opening.

17. The method according to claim 14 wherein the step of placing the string comprises:

placing the string through the opening;

frictionally retaining the middle portion of the string behind the opening; and frictionally retaining the ends of the string on each side of the frame between the top portion and the base portion.

* * * * *